US006964101B2

(12) United States Patent
Graves et al.

(10) Patent No.: US 6,964,101 B2
(45) Date of Patent: Nov. 15, 2005

(54) LIGHTWEIGHT GUIDE BAR FOR CHAINSAW

(75) Inventors: Sandra D. Graves, Lake Oswego, OR (US); R. Mark Poff, Milwaukie, OR (US); Kent L. Huntington, Molalla, OR (US)

(73) Assignee: Blount, Inc., Portland, OR (US)

( * ) Notice: Subject to any disclaimer, the term of this patent is extended or adjusted under 35 U.S.C. 154(b) by 39 days.

(21) Appl. No.: 10/318,538

(22) Filed: Dec. 12, 2002

(65) Prior Publication Data

US 2004/0111897 A1 Jun. 17, 2004

(51) Int. Cl.[7] ..... B27B 17/02
(52) U.S. Cl. ..... 30/387; 30/383
(58) Field of Search ..... 30/387, 383; 76/112

(56) References Cited

U.S. PATENT DOCUMENTS

| | | | | |
|---|---|---|---|---|
| 3,191,646 | A | | 6/1965 | Merz |
| 3,416,578 | A | | 12/1968 | Irgens |
| 3,473,581 | A | | 10/1969 | Merz |
| 3,545,505 | A | | 12/1970 | DeWesse et al. |
| 3,949,475 | A | | 4/1976 | Tokarz |
| 4,138,813 | A | | 2/1979 | Harada et al. |
| 4,393,590 | A | | 7/1983 | Pantzar |
| 4,641,432 | A | | 2/1987 | Kume |
| 4,693,007 | A | | 9/1987 | Apfel et al. |
| 4,722,141 | A | * | 2/1988 | Lim et al. ..... 30/384 |
| 4,794,696 | A | | 1/1989 | Apfel et al. |
| 4,837,934 | A | | 6/1989 | Krohn |
| 4,885,843 | A | | 12/1989 | Kelsay, III et al. |
| 4,903,410 | A | | 2/1990 | Wieninger et al. |
| 4,961,263 | A | | 10/1990 | Apfel et al. |
| 5,014,435 | A | | 5/1991 | Date et al. |
| 5,025,561 | A | | 6/1991 | Sugihara et al. |
| 5,035,058 | A | | 7/1991 | Date et al. |
| 5,067,243 | A | | 11/1991 | O'Neel |
| 5,216,814 | A | | 6/1993 | McGregor |
| 5,249,363 | A | | 10/1993 | Mitrega et al. |
| 5,271,157 | A | | 12/1993 | Wieninger et al. |
| 5,564,192 | A | | 10/1996 | Wilhelm et al. |
| 5,666,733 | A | | 9/1997 | Nitschmann |
| 5,669,140 | A | | 9/1997 | Tsumura |
| 5,842,279 | A | | 12/1998 | Andress et al. |
| 6,138,339 | A | | 10/2000 | Escher et al. |
| 6,427,342 | B1 | * | 8/2002 | Breitbarth et al. ..... 30/387 |
| 2002/0046468 | A1 | | 4/2002 | Kobayashi |

FOREIGN PATENT DOCUMENTS

| | | |
|---|---|---|
| DE | 004318492 A1 | 12/1994 |
| DE | 04318492 | 12/1994 |
| EP | 92301891.5 | 3/1992 |
| EP | 000503840 A1 | 9/1992 |
| JP | 63223671 | 9/1988 |
| JP | 401105702 A | 4/1989 |
| JP | 04301409 | 10/1992 |

* cited by examiner

*Primary Examiner*—Charles Goodman
(74) *Attorney, Agent, or Firm*—Schwabe, Williamson & Wyatt, P.C.

(57) ABSTRACT

A lightweight guide bar formed from a heavy material, e.g., steel, and having a center section, e.g., a cavity of reduced material and fitted with a lighter weight insert, e.g., aluminum plate. The center section includes a flange to which the aluminum plate is adhered and a spacer lip defines the desired thickness of the adhesive. Adhesive is applied to the desired thickness under the lip and the aluminum plate is abutted against the lip and into contact with the adhesive for adhering of the plate to the flange. In a preferred embodiment, the flange is a continuous web down the center of the center section and insert plates are adhered to each side of the web. Also, preferably the inserts are oval and symmetrical and are selectively mechanically secured to the flanges by rivets.

9 Claims, 6 Drawing Sheets

LIGHTWEIGHT GUIDE BAR FOR CHAINSAW

FIELD OF THE INVENTION

This invention relates to a heavy-duty, e.g., steel, guide bar that is mounted to the power head of a chainsaw for guiding a saw chain in a cutting operation, and more particularly to such a bar that is provided with a center section whereat the steel is replaced with a lighter weight insert for weight reduction

BACKGROUND OF THE INVENTION

Chainsaws used for felling large trees are necessarily provided with long guide bars as required to cut through the girth of a large tree. Such a guide bar may be on the order of 3 feet in length. Such bars are typically made of steel, a heavy material. Considering that the bar and the chain that is mounted on the bar extends outwardly from the power head whereat the user's handles are located, the weight of the bar and chain is a substantial burden to the chainsaw operator as he moves about in a forest from tree to tree.

The weight of the bar can be reduced by replacing a center section of the bar with a lighter weight material. Such is the proposal of commonly owned U.S. Pat. No. 6,427,342 the disclosure of which is incorporated herein by reference. That proposal replaces the heavy steel material with an aluminum insert. Whereas the objective of reducing the weight is achieved, the machining requirements for fitting and securing the insert to the bar center adds substantial cost. It is accordingly an objective of the invention to provide the desired fit and securement of a lightweight insert to a bar while reducing the cost, e.g., as compared to the teaching of the '342 patent.

BRIEF DESCRIPTION OF THE INVENTION

The '342 patent teaches the removal of an elongate oval-shaped center section of the steel bar but leaving a configured rib or flange surrounding the inner edge of the opening. (Hereafter the bar with opening is sometimes referred to as the bar frame.) A pair of aluminum plates is precisely machined so that when the plate edges are abutted against the bar frame flange, the inner faces of the insert plates are in close adjacency, e.g., in abutment. The abutting edges are glued to the flange and the abutting faces of the plates are glued together to thereby secure the insert plates to the bar frame. In the '342 patent, projecting tabs at each end of the insert plates are inserted into corresponding slots in the bar frame to assist in securing the insert to the bar frame.

There are at least three improvements to the above '342 guide bar that are provided by the preferred embodiment of the present invention. It is desirable to have a more secure attachment of the inserts to the bar frame. This is accomplished for the preferred embodiment by providing an extension of the flange at the top and bottom of the opening sufficient to permit riveting of the insert plates directly to the flange of the bar frame. (The tabs and slots as present in the '342 structure are thereby eliminated.) Secondly, there is a desired thickness of the glue to achieve optimum bonding which is not achieved by the '342 structure. This desired thickness is achieved for the preferred embodiment by providing a spacer lip at the periphery inside the bar face opening against which the insert plate is directly abutted to thereby precisely position the inner faces, e.g., relative to each other to create the desired spacing for the glue thickness.

The third improvement achieves cost reduction. Previously, the insert plates had to be provided with precisely configured edges (an edge step) to achieve the desired relationship of the plates with the bar frame opening and surrounding flange, and to each other. This is avoided for the preferred embodiment of the present invention by extending the flange of the bar frame so as to provide a continuous web at the center of the bar frame opening. The web is machined (milled) to provide a precisely formed cavity at each side of the bar, and including the spacer lip surrounding the periphery of the cavity against which the insert plates are abutted. The insert plates are planar and can be laser cut or blanked (no edge step) from an aluminum sheet of the desired thickness.

As an example of such structure, the web of steel that separates the cavity is 0.024" thick, and the total thickness of the bar frame is 0.190" thick. A spacer lip is provided inside each cavity at the periphery of the web and raised from the face of the web by 0.005", the desired thickness of the glue. The total distance between the two interfaces of the insert plates is 0.010 (0.005×2) plus 0.024" (the web thickness) or 0.034, and the combined thickness of the insert plates is 0.160 (0.080×2). The total thickness of the insert portion (including web thickness, glue spacing and plate thickness) is 0.194" to place the outer faces of the inserts slightly raised from the outer faces of the bar frame, i.e., by 0.002" at each side of the bar. Thus, the desired quantity of glue is laid onto the bottom of the cavity (but not on the spacer lip) and the two insert plates are simply laid into the cavity. The 0.002" set out of the plates allows for pressure to be applied against the lip and accordingly against the glue. It is desired that the faces of the inserts be sanded after assembly in any event to achieve true flatness of the bar faces. All of the complex machining is done on the bar frame to generate the opposing cavities and spacer lips. The insert plates as explained are merely edge cut, e.g., laser-cut or blanked, etc., to the desired shape to fit the cavity in that the sheet in its entirety is already the desired thickness.

DETAILED DESCRIPTION

Figure 1:
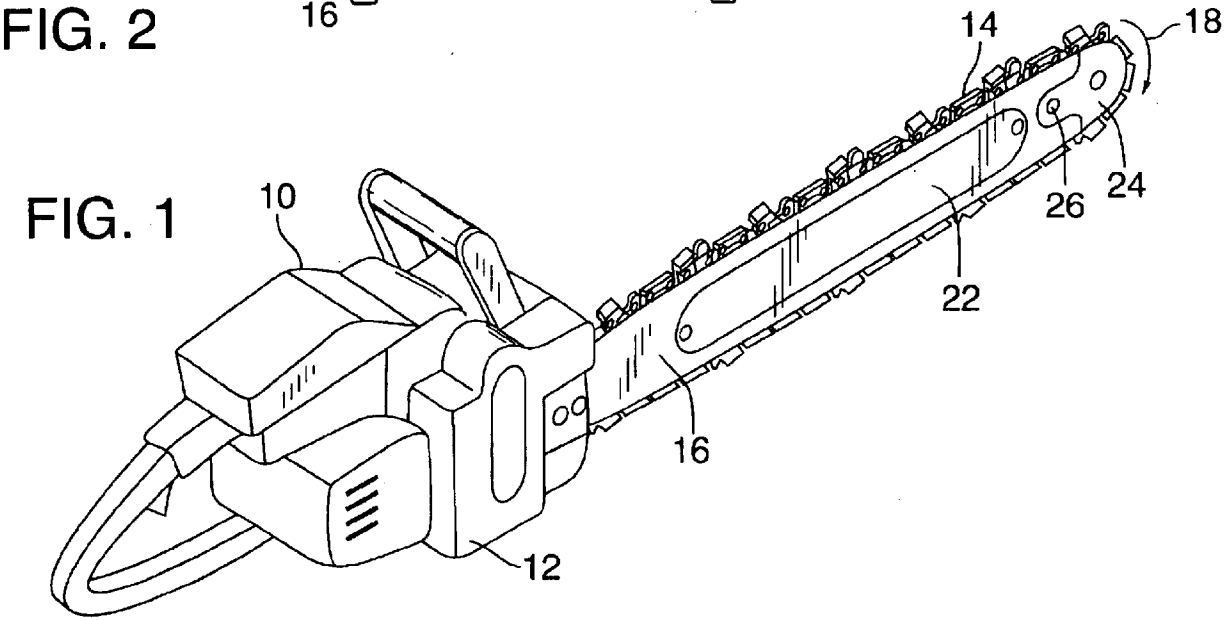
FIG. 1 is a perspective view of a chainsaw incorporating the present invention.

FIG. 1 illustrates a chain saw in accordance with the present invention including a power head 10, a drive housing 12 wherein one end of a guide bar 16 is housed for driving a saw chain 14 around the guide bar as indicated by arrow 18.

Figure 2:
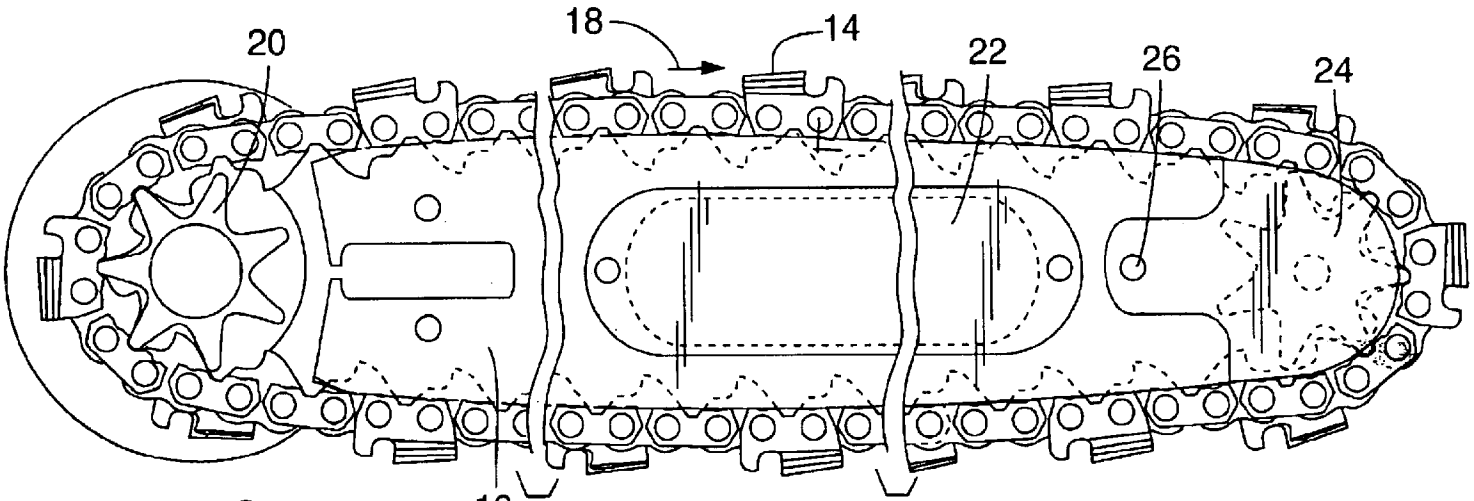
FIG. 2 is a side view of the guide bar, saw chain and drive mechanism of the chainsaw of FIG. 1.

FIG. 2 is an enlarged side view of the bar and chain of FIG. 1 showing a drive sprocket 20 of the power head 10 (mounted in the drive housing 12) for driving the chain as indicated by arrow 18.

Reference No. 22 indicates the provision of an insert throughout the major length of the guide bar 16. The primary objective of the insert 22 is to lessen the weight of the bar and chain assembly as projected outwardly from the power head 10 without sacrificing performance. The portion of the guide bar 16 minus the insert 22 is hereafter referred to as the bar frame 16' and the combination of bar frame 16' and insert 22 is described in detail having reference to FIG. 3.

Figure 3:
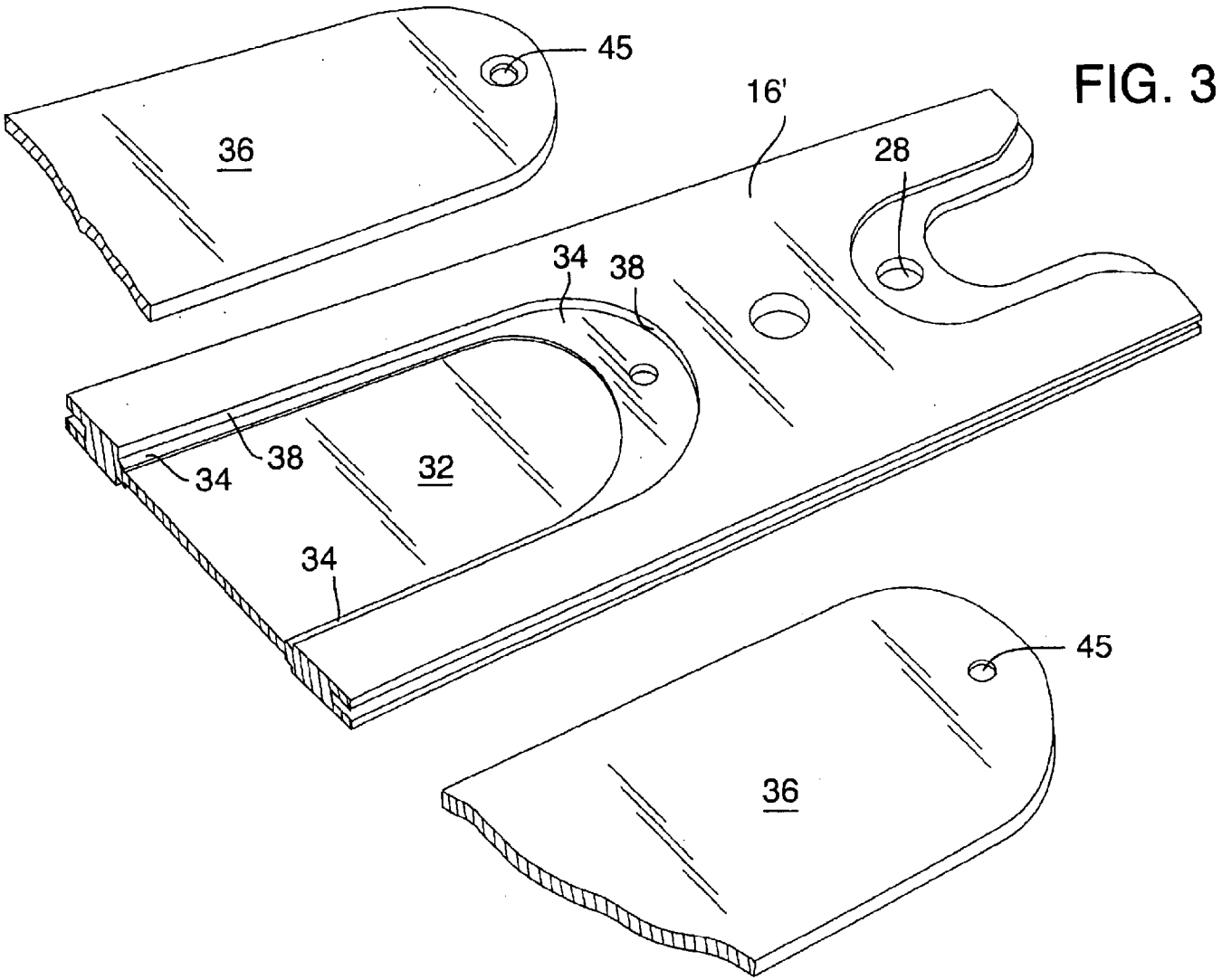
FIG. 3 is a perspective exploded view of the nose portion of the guide bar of FIG. 2.

FIG. 3 is an exploded view of the nose portion of the guide bar 16, but without the chain 14 and nose sprocket assembly 24. (The nose sprocket assembly 24 is secured to the configured nose-end of FIG. 3 as by riveting, i.e., rivet 26 as seen in FIGS. 1 and 2 which is extended through rivet hole 28 of FIG. 3).

Figure 4:
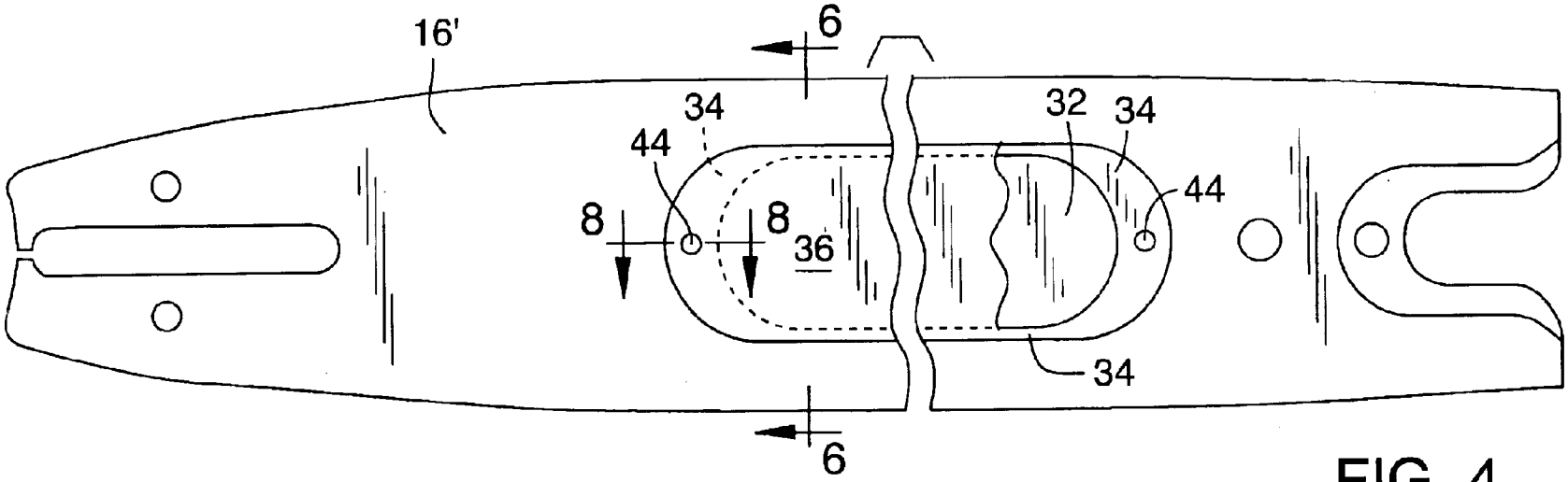
FIG. 4 is a side view of the guide bar of FIG. 2 showing portions thereof broken away.
Figure 6:
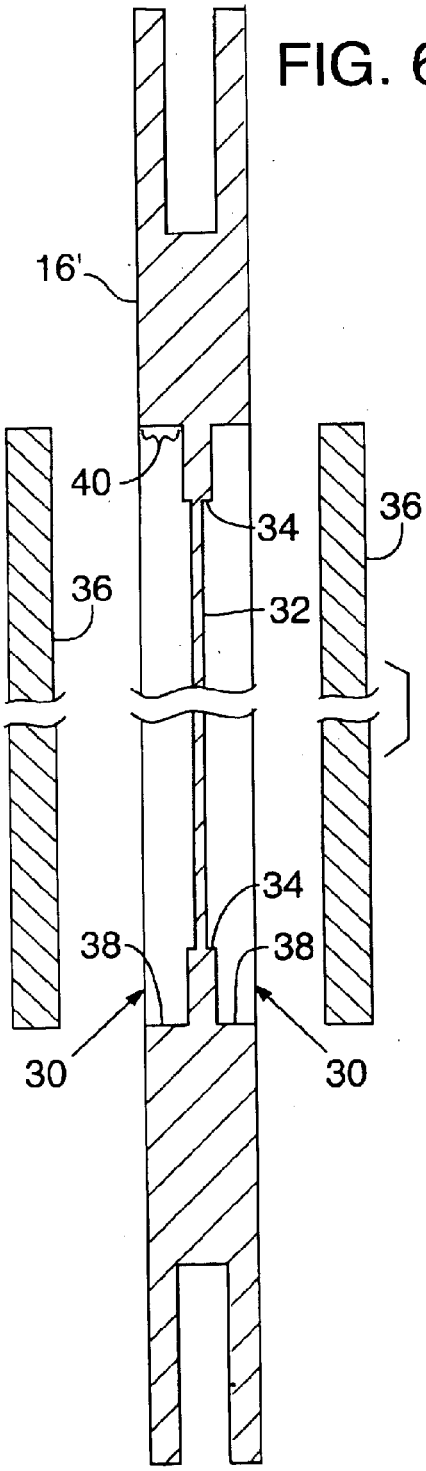
FIG. 6 is a sectional view (but exploded) as taken on view lines 6—6 of FIG. 4.
Figure 7:
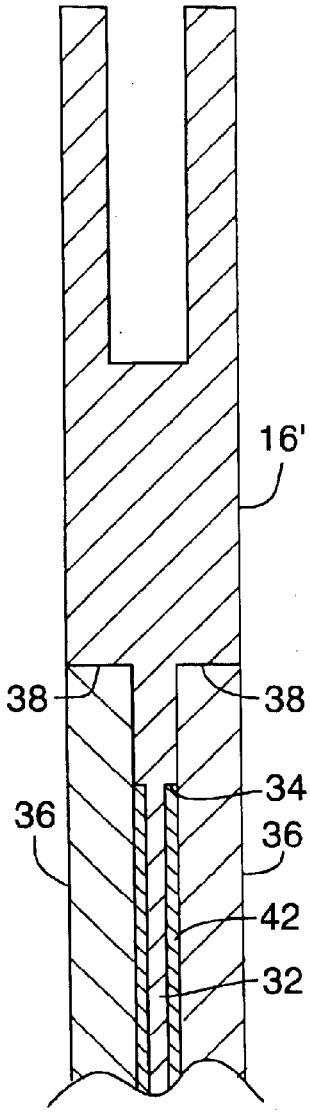
FIG. 7 is a partial view similar to the view of FIG. 6 but in assembled form.
Figure 8:
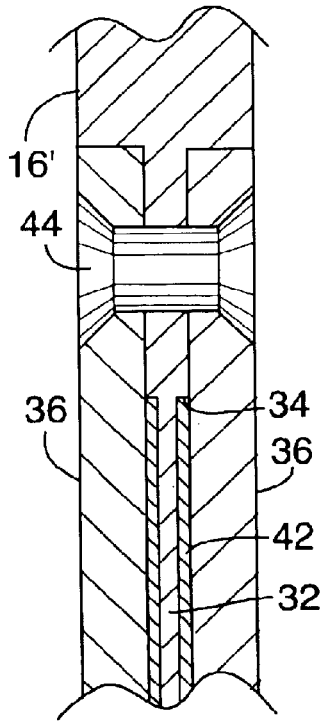
FIG. 8 is a section view as taken on view lines 8—8 of FIG. 4.

FIG. 4 is a side view of the guide bar 16, but also minus the nose sprocket assembly 24 and disassembled from power head 10. FIG. 6, like FIG. 3 shows the insert plates 36 exploded from the bar frame 16' and taken on view lines 6—6 of FIG. 4 and FIGS. 7 and 8 show the insert plates 36 assembled to the bar frame.

With reference primarily to FIG. 6 (but see also FIG. 3), it will be seen that bar frame 16' is configured to have opposing cavities or openings 30 that are similarly configured and separated by a web 32. The web 32 is exposed at each side of the bar with a lip 34 that surrounds each cavity as can be seen best by comparing FIGS. 3, 4 and 6.

The cavities are produced by precision machinery, e.g., a milling machine, an example of which is MAZAK multiple operation machining center, which removes the material of the bar (preferably steel) to the exact depth and shape as illustrated. The lip 34, as will be noted, provides a small landing at the side edges and a larger landing at the opposing ends.

Figure 5:
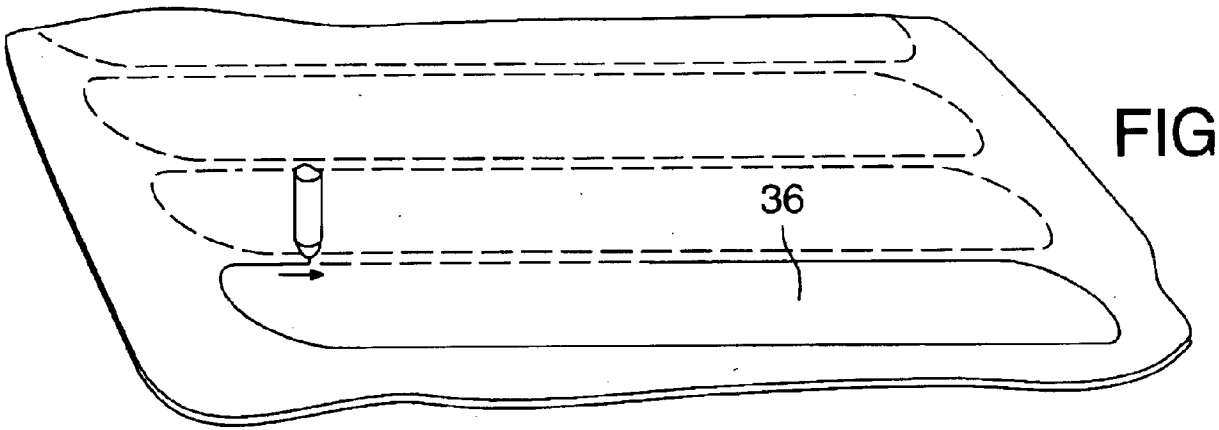
FIG. 5 is a schematic perspective view illustrating the production of an insert plate of the guide bar of FIGS. 2 and 4.

Reference is now made to the insert structure 22 which is provided by opposing insert plates 36 and web 32. The insert plates 36 are a simple symmetrical oval shape that is mated (fitted) to the periphery 38 of the cavities 30. The configuration of the plates 36 is preferably, but not necessarily, shaped so that it will fit either cavity and regardless of how they are assembled to the cavity, i.e., either end or either side. The plates are preferably cut from a designated thickness of aluminum sheeting using a simple cutting process, e.g., laser cutting as schematically illustrated in FIG. 5. Other examples of cutting are stamping or blanking and other lightweight materials include titanium, fiber reinforced composite material, plastic and the like.

The thickness of plate 36 is intended to fit the depth of the cavity from the lip 34 out to the side face of the bar frame, i.e., thickness 40 as illustrated in FIG. 6. With the single-thickness plates 36 mounted in the cavities, the plates are abutted against the peripheral lip 34 and a spacing is formed at the bottom of the cavities inside the lip. That spacing (height of lip 34) is provided to accommodate a desired thickness of adhesive 42 as may be recommended by the adhesive manufacturer for optimum adhesion, e.g., of an aluminum plate to a steel web.

Whereas the above indicates an exact precision interfit, in practice it is preferred that the thickness of the insert plate 36 is slightly greater than the designated thickness or spacing 40 to facilitate application of pressure of the inserts against the adhesive. The sides are then sanded for achieving a seamless-appearing fit of the plates to the cavities which is also desired.

It is also preferable that the insert plates 36 be mechanically secured at the ends in addition to the adhesive bonding described. Refer to FIG. 8 illustrating in section the outer end of plate 36 assembled to the bar frame 16', i.e., view lines 8—8 of FIG. 4. As will be noted from FIG. 4, the lip portion 34 is extended inwardly from periphery 38 both at the inner and outer ends of the assembly and a rivet 44 is extended through the rivet holes 45 and headed as shown in FIG. 8, to mechanically secure the insert plates 36 to the bar frame 16'.

Figure 12:
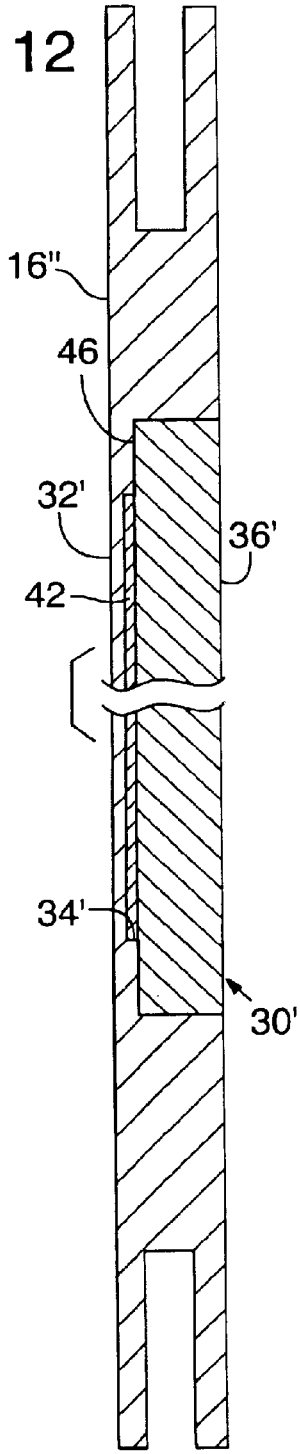
FIG. 12 is a further embodiment of the invention.

The above description discloses a preferred embodiment of the invention. An example of an alternative embodiment is shown in FIG. 12 wherein cavity 30 is provided on one side only. The web 32' is provided at the opposite side and forms the opposite side wall of the bar frame 16". A single insert plate 36' having substantially twice the thickness of the plates 36 fills the cavity 30' and the cavity 30' is provided with the prescribed lip 34' for accommodating the bonding agent/adhesive 42.

Figure 9:
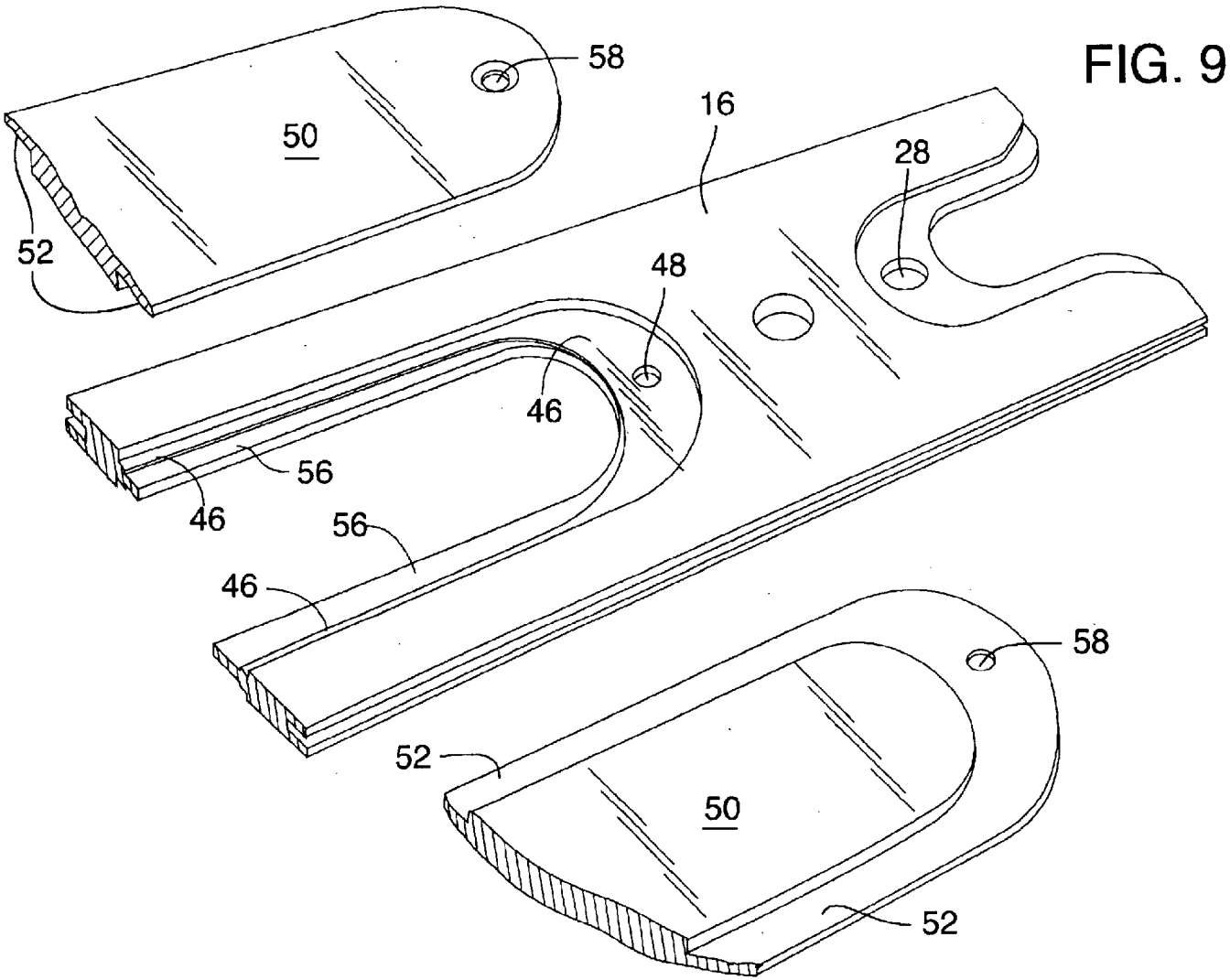
FIG. 9 is a perspective view of the nose portion of a second embodiment of a guide bar in accordance with the invention.
Figure 10:
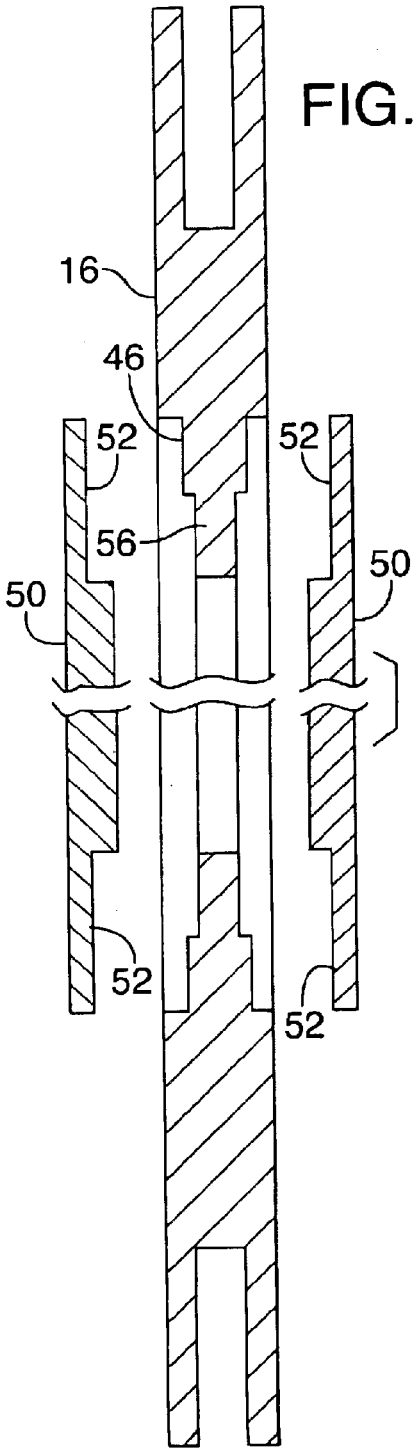
FIGS. 10 and 11 are section views similar to FIGS. 6 and 7 but for the second embodiment of FIG. 9.
Figure 11:
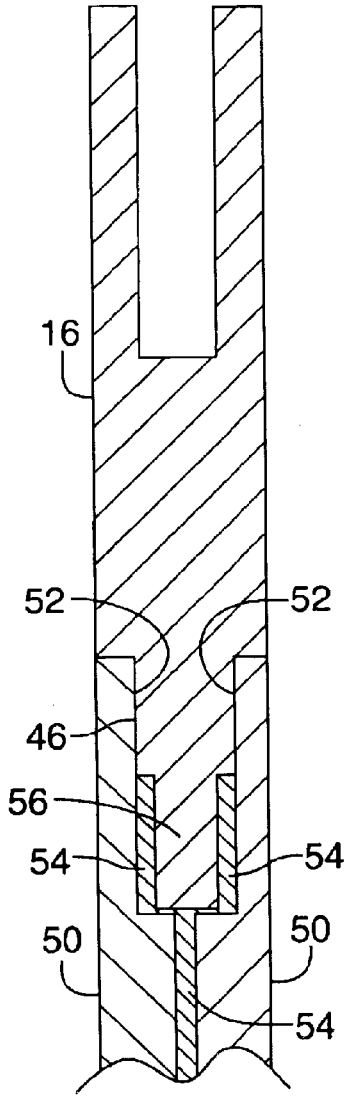

A further alternative that does not include the full web but instead a partial web or flange 46 as illustrated in FIGS. 9–11. FIG. 9 like the preferred embodiment of FIG. 3 includes a spacing lip 46 and the extension of the lip 46 at the ends to accommodate a rivet (not shown) through aligned rivet holes 48 and 58.

The lip 46 provides the desired spacing for the adhesive 54 and rivets provide the mechanical securement, both features being desirable. Instead of the continuous web as the seating against which the insert plates 50 are abutted, this embodiment provides a partial flange 56 and as noted requires additional machining of the insert plates 50 to achieve the edge step 52 that abuts the lip 46 and provides the desired spacing for the adhesive 54 (see FIG. 11).

The above are but examples of alternative embodiments and others skilled in the art will conceive of numerous other embodiments/modifications all being within the scope of the invention as determined from the scope of the appended claims.

The invention claimed is:

1. A planar elongate chainsaw guide bar having a length, guide edge and planar sides comprising:

a bar frame of heavy durable material and having a center section of reduced material thickness, and an insert of relatively lighter weight material assembled to the bar frame within said center section and cooperatively forming a continuum of the planar saw chain guide bar;

said center section of reduced material defining a periphery surrounding a configured cavity defined in part by a flange formed from the bar frame material, the flange projected axially inwardly of the periphery, and further defining a lip spaced laterally outwardly of said flange;

said insert being a plate sized to fit the defined periphery and abutted directly against the lip when assembled to the bar frame, said plate as abutted against said lip, providing a defined space between the flange and plate for inclusion of a defined thickness of adhesive.

2. A planar chainsaw guide bar as defined in claim 1 wherein the bar has a defined width and the flange is centered between the bar sides and defining opposed cavities, said insert being a pair of plates, one for each cavity.

3. A planar chainsaw guide bar as defined in claim 2 wherein the flange extends across the center section to form a continuous web, said plates when assembled to said bar frame spaced from the web and provided with the desired thickness of adhesive adhering the plates to the web.

4. A planar chainsaw guide bar comprising:

a bar frame of heavy durable material and having a center section of reduced material thickness, and an insert of relatively lighter weight material assembled to the bar frame within said center section and cooperatively forming a continuum of the planar saw chain guide bar;

said center section of reduced material defining a periphery surrounding a configured cavity defined in part by a flange that spans at least a significant portion of the cavity;

said insert being a plate sized to fit the defined periphery and abutted against the flange when assembled to the bar frame, said flange also extended at the inner and outer ends of the center section to accommodate a rivet at each end for mechanically securing the plate to the flange and an adhesive further securing abutting faces of the flange and insert plate.

5. A planar chainsaw guide bar as defined in claim 4 wherein the flange is centered in the center section and provides opposing cavities and opposing insert plates secured to the flange.

6. A planar chainsaw guide bar comprising:

a bar frame of heavy durable material and a center section of reduced material thickness, and an insert of relatively lighter weight material assembled to the bar frame within said center section and cooperatively forming a continuum of the planar chainsaw guide bar;

said guide bar having a defined width and said bar frame defining said bar width surrounding said center section, and an integral web formed of the bar material of said bar frame that is reduced in width and extended across said center section, said web defining a peripheral edge and a cavity, an insert plate of lighter weight material sized to fit within said cavity and coupled to said web.

7. A planar chainsaw guide bar as defined in claim 6 wherein a spacer lip is provided on said web at the peripheral edge and the insert plate abutted against said lip and fitted to the peripheral edge, said spacer lip defining a spacing between facing sides of said web and insert plate, and a desired thickness of adhesive filling said spacing.

8. A planar chainsaw guide bar as defined in claim 7 wherein said web is centered relative to the width of the bar frame to form opposing cavities on each side of the web and a spacer lip at the peripheral edge of each side, and an insert plate provided for each cavity abutted against said spacer lip and forming a spacing, and adhesive of a desired thickness provided in each of said spacings.

9. A planar chainsaw guide bar as defined in claim 7 wherein said web provides one side face of the bar frame of the center section and providing a single cavity at the other side, said insert plate occupying said cavity.

* * * * *